United States Patent [19]

French, III

[11] Patent Number: 4,756,012

[45] Date of Patent: Jul. 5, 1988

[54] SURFACE MOUNTED DEVICE PARTS COUNTER

[75] Inventor: Albert L. French, III, Albany, Oreg.

[73] Assignee: Hewlett-Packard Company, Palo Alto, Calif.

[21] Appl. No.: 20,262

[22] Filed: Feb. 27, 1987

[51] Int. Cl.[4] ..... G06M 3/12; G06M 7/00

[52] U.S. Cl. ..... 377/8; 377/18; 377/30; 377/16

[58] Field of Search ..... 377/6, 8, 15, 16, 18, 377/30

[56] References Cited

U.S. PATENT DOCUMENTS

| | | | |
|---|---|---|---|
| 3,569,680 | 3/1971 | Cox | 377/30 |
| 3,718,807 | 2/1973 | Brucken et al. | 377/15 |
| 3,792,241 | 2/1974 | Sullivan | 377/30 |
| 3,941,981 | 3/1976 | Abe et al. | 377/18 |
| 4,166,246 | 8/1979 | Matt | 377/8 |
| 4,429,408 | 1/1984 | Hibari | 377/8 |
| 4,513,430 | 4/1985 | Vora et al. | 377/8 |

*Primary Examiner*—John S. Heyman
*Attorney, Agent, or Firm*—Bloor Redding, Jr.

[57] ABSTRACT

A method and apparatus for counting the exact number of electrical circuit components carried by a length of component dispensing tape is disclosed. In the preferred embodiment, the invention uses optical detectors to detect the transmission of light through tape index holes and component carrier compartment holes and variously to increment or inhibit operation of a counter accordingly. In one form of the invention, the circuitry is adapted to detect automatically whether the tape is optically transmissive or opaque and to modify the counting scheme accordingly.

17 Claims, 4 Drawing Sheets

SURFACE MOUNTED DEVICE PARTS COUNTER

TECHNICAL FIELD

The present invention relates to a method and apparatus for counting the number of electrical circuit parts, such as surface mounted devices, carried by a length of component dispensing tape.

BACKGROUND OF THE INVENTION

Surface mounted devices are small leadless components that are being used increasingly in the assembly of electronic circuitry by robotic equipment. To facilitate their handling by automated assembly equipment, these components are generally provided in carrier compartments on a component dispensing tape. Each carrier compartment is sized to contain a single component. An exemplary tape may be eight millimeters in width and sized to contain components that measure 3 mm by 1.5 mm by 0.5 mm.

Along one side of the component dispensing tape are tractor drive or index holes. The automated assembly equipment generally includes a toothed drive wheel that advances the tape by engagement with these holes. The spacing between the holes corresponds to the spacing between the carrier compartments so that when the tape is advanced one hole, a single component is advanced, usually to a robotic assembly arm for placement on a circuit board.

Sometimes the component carrier compartment advanced to the robotic assembly arm is empty. Empty carrier compartments in a tape may be the result of a variety of causes, but can most often be traced to the process by which the components are loaded into the carrier compartments by the component supplier. In order for the automated assembly equipment to function properly despite its occasional encounters with empty carrier compartments, such equipment is usually provided with a system for detecting whether a component carrier compartment is full. Typically, this system monitors the pressure in a vacuum probe that is used to pick up components for placement on the circuit board. When the vacuum increases, the probe has successfully lifted a component. If the equipment finds that a carrier compartment is empty, it causes the toothed drive wheel to advance the tape by another tractor drive hole in an attempt to provide a component to the robotic assembly arm.

The component dispensing tape is generally provided in reel form, with a single reel having approximately 10 to 25 feet of tape. Depending on the density of component carriers in the tape, such a reel may contain thousands of components.

Prudent principles of inventory management dictate that thousands of components should not sit idly at an assembly station, waiting, sometimes for a year or more, to be used in the assembly of a circuit board. Certain surface mounted components, such as integrated circuits, are relatively costly, so that a full reel of components may cost in excess of $10,000. In order to better manage component supply and demand, it is desirable to provide each assembly station with only the number of components that it is expected to use in a certain product run or in a certain period of time.

In the prior art, the length of tape needed to supply a desired number of components to an assembly station was determined manually. Since counting each of the desired number of components was impractical, the number of components in a short length of the tape was counted instead. The length of tape required for a particular assembly run was then estimated based on the component density of the sampled length of tape, taking into account the occurrences of empty carrier compartments in the sampled tape. The desired length of tape could then be unrolled, measured and cut. Although somewhat wasteful of components, the tape would generally be cut slightly longer than the computed length to ensure that the equipment did not prematurely exhaust its components supply before the assembly run was completed.

This prior art method is cumbersome and poorly suited for use with today's highly automated circuit board assembly techniques. The prior art method is also inaccurate. The component density in a short length of tape is not necessarily indicative of the component density throughout the reel.

SUMMARY OF THE INVENTION

To overcome these drawbacks of the prior art, the present invention provides a method and apparatus for counting the exact number of components carried in a length of component carrier tape. The preferred embodiment of the invention makes use of optical detectors to detect the transmission of light through the tractor drive holes and through holes in the component carrier compartments (termed here "component carrier sense holes") of the tape and variously to increment or inhibit operation of a counter accordingly.

In one form of the invention, the circuitry is adapted to detect automatically whether the tape is optically transmissive or opaque and to alter the counting logic appropriately.

Thus, it is one object of the present invention to provide an improved method and apparatus for counting the number of electrical circuit components, such as surface mounted devices, carried by a length of component carrier tape.

It is another object of the present invention to provide a method and apparatus for counting the number of components carried by a length of component carrier tape regardless of whether the tape is optically transmissive or opaque.

It is a further object of the present invention to provide an apparatus for counting components carried by a length of component carrier tape that can be used with tapes of differing widths.

It is still another object of the present invention to provide an apparatus for counting components carried by a length of component carrier tape that can be optimized for use with tapes of differing optical qualities.

These and other objects, features and advantages of the present invention will be more readily apparent from the detailed description, which proceeds with reference to the accompanying drawings.

DETAILED DESCRIPTION

General Overview

Figure 1:
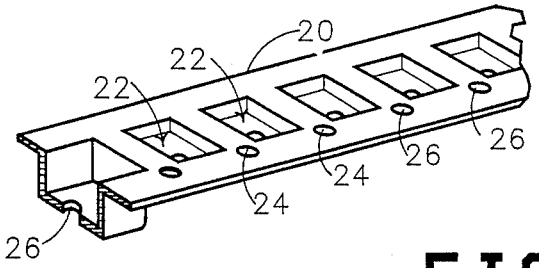
FIG. 1 is an isometric view of a component carrier tape used in the present invention.
Figure 2:
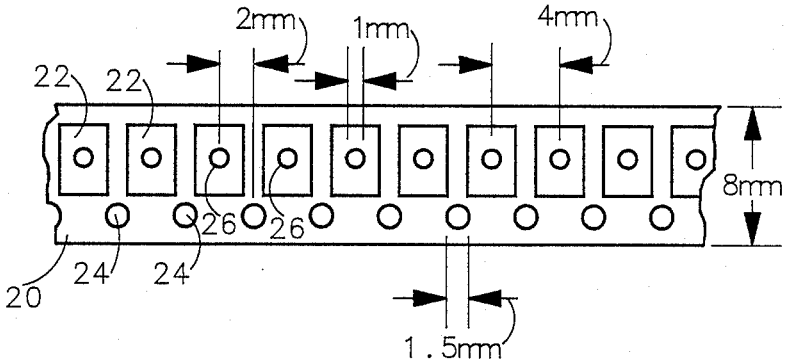
FIG. 2 is a top plan view of the tape of FIG. 1.

As shown in FIGS. 1 and 2, a component dispensing tape 20 carries electrical circuit components within compartments 22 on such tape. Each compartment is sized to contain a single component, typically a surface mounted device. Tractor drive or index holes 24 are spaced along one side of the tape and sense holes 26 are positioned in the bottom of the component carrier compartments 22. In the illustrative tape shown in FIG. 2, the tape is 8 millimeters in width and includes index holes 24 1.5 millimeters in diameter spaced 4 millimeters apart. Sense holes 26 are 1.0 millimeter in diameter and are spaced 4 millimeters apart. Each sense hole 26 is thus spaced 2.0 millimeters behind the preceding index hole 24.

Figure 3:
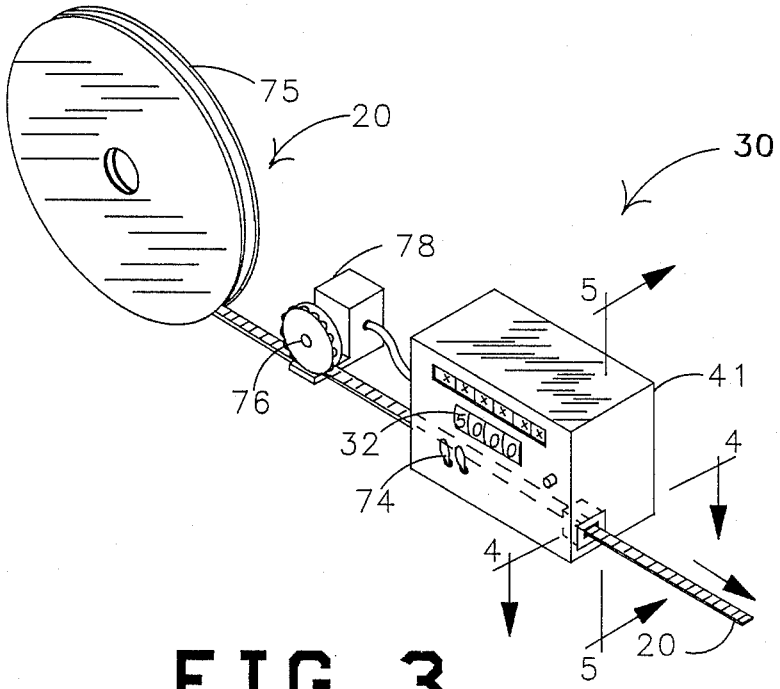
FIG. 3 is an isometric view of a complete parts counting station according to the present invention.
Figure 4:
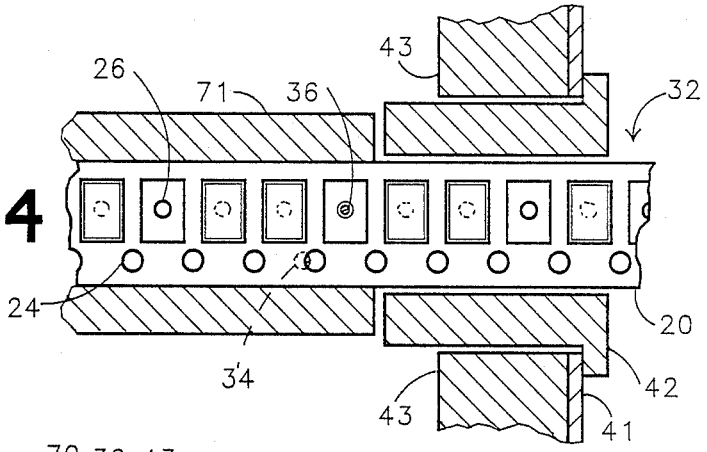
FIG. 4 is a fragmentary horizontal section view taken along lines 4—4 of FIG. 3 showing the position of the tape within the counting apparatus.
Figure 5:
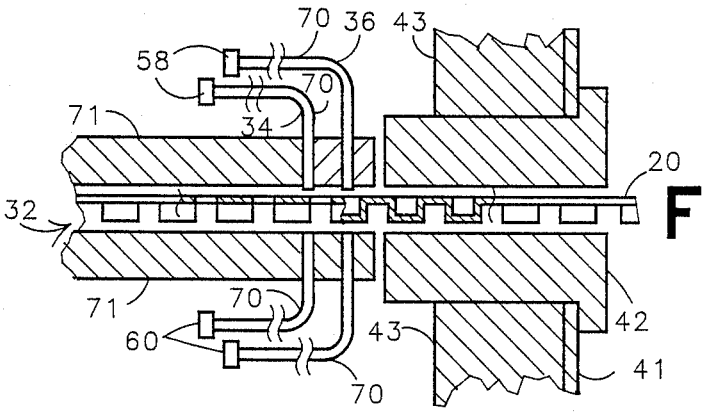
FIG. 5 is a fragmentary vertical section view taken along lines 5—5 of FIG. 3 showing the position of the tape within the counting apparatus.

With reference to FIGS. 3–5, the preferred embodiment of a surface mounted device parts counter apparatus 30 according to the present invention includes a guide track 32 and first and second detectors 34, 36. Guide track 32 positions tape 20 in a desired orientation as the tape is moved through the apparatus. First, or index hole detector 34 is positioned for detecting tractor drive, or index holes 24 in tape 20 when the tape is moved through guide track 32. Second, or sense hole detector 36 is positioned for detecting sense holes 26, indicative of empty carrier compartments, when tape 20 is moved through the guide track 32.

Figure 8:
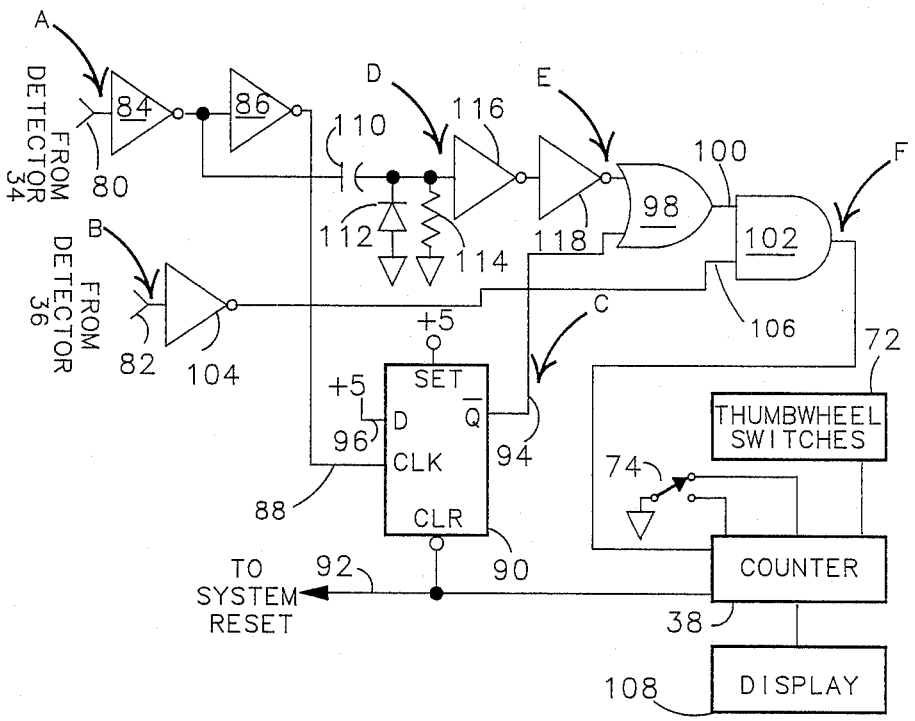
FIG. 8 is a schematic diagram of logic circuit suitable for use with the present invention.

The outputs from first and second detectors 34, 36 are fed to a counter circuit 38 through a logic circuit 40 (FIG. 8). Counter 38 normally counts index holes 24 as they are detected by first detector 34. When, however, second detector 36 detects an empty carrier compartment 22, logic circuit 40 inhibits counter 38 from counting the next index hole. Thus, the total count accumulated in counter 38 equals the number of index holes detected less the number of empty carrier compartments detected. This count equals the number of full component carrier compartments 22 that have passed first and second detectors 34, 36.

Guide Track

In the apparatus shown in FIGS. 3–5, guide track 32 defines a horizontal slot through which the tape can be routed. When the tape is routed through this slot, index holes 24 and sense holes 26 are aligned so that they can be detected by first detector 34 and second detector 36, respectively.

Apparatus 30 is desirably contained in an enclosure 41 which includes openings in its side walls for receiving guide track adapters 42. Guide track adapters 42 can be inserted into these openings for changing the width of guide track 32 so that the apparatus can be used with tapes of various widths. Guide track alignment members 43 are provided inside enclosure 41 to insure proper alignment of guide track adapters 42 within the enclosure. In the embodiment shown in FIGS. 3 and 4, an adapter 42 has been received in enclosure 41 in order to accommodate eight millimeter tape.

Figure 6:
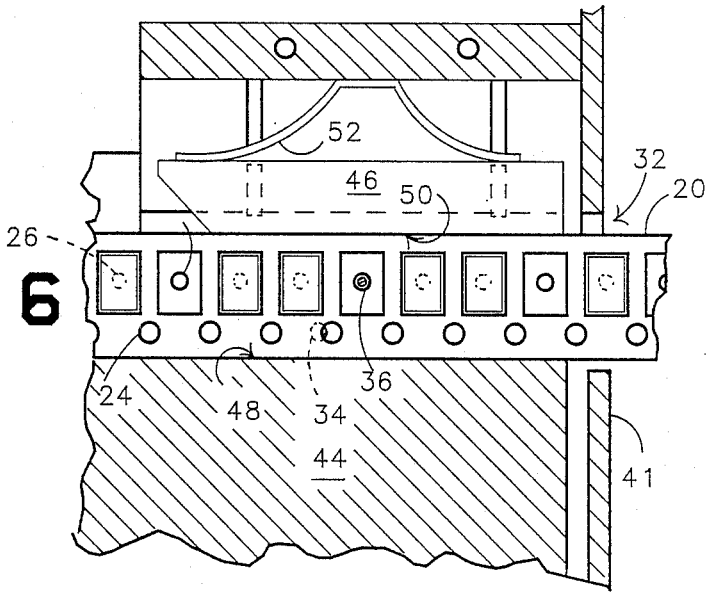
FIG. 6 is a section view similar to FIG. 4 but showing an alternative system for positioning the tape within the counting apparatus.

In another form of the invention, shown in FIG. 6, guide track 32 is defined by first and second registration members 44, 46 between which tape 20 is positioned when it is pulled through the apparatus. First registration member 44 is fixed and provides a stable surface 48 against which a first edge of tape 20 can abut when it is pulled through the apparatus. Second registration member 46 is movably mounted and provides a movable but stable surface 50 against which the opposite, second edge of tape 20 can abut when it is pulled through the apparatus. The movable mounting of second registration member 46 desirably includes a spring 52 for biasing the second registration member towards the first registration member so that both registration members are urged against tape 20 regardless of its width. Guide track 32 is thereby enabled to adapt automatically to tapes of differing widths.

Photoelectric Detectors

With reference to FIGS. 4–8, first and second detectors 34, 36 are desirably photoelectric source and detector pairs positioned for detecting optical continuity through index holes 24 and sense holes 26, respectively. The photoelectric sources can comprise simple light emitting diodes 58. The photoelectric detectors can comprise phototransistor circuits 60 of FIG. 7.

Figure 7:
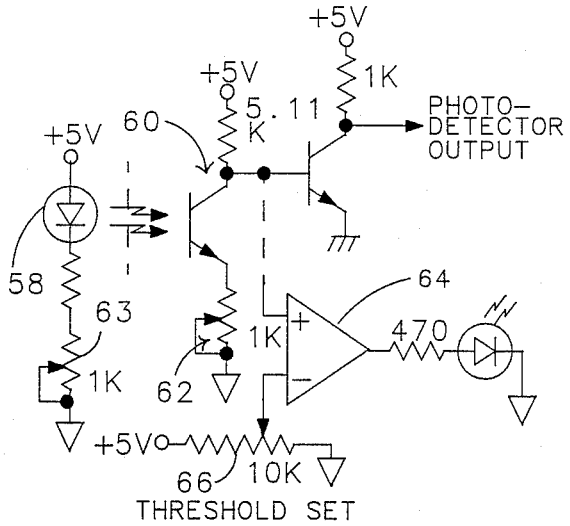
FIG. 7 is a schematic diagram of a photodetector circuit and optional threshold detector circuit for use with the present invention.

In certain embodiments, it may be desirable to adjust the sensitivity of the photodetectors in order to optimize performance of the apparatus with tapes of differing optical qualities. For example, if the tape is optically translucent, it may be desirable to reduce the sensitivity of the photodetectors in order to prevent the photodetectors from sensing light passed through the tape itself. Accordingly, phototransistor circuit 60 of FIG. 7 is illustrated as including a potentiometer 62 for adjusting the sensitivity of the circuit.

In alternative embodiments, the sensitivity of the photodetectors can be varied by varying the intensity of light emitted by the photoelectric sources. Such an alternative system is also shown in FIG. 7 and comprises a potentiometer 63 for varying the current through light emitting diode 58.

With reference to FIG. 5, first and second photodetectors 34, 36 are spaced only a few millimeters apart. In order to effect such close spacing, it is desirable to couple photoelectric sources 58 and photodetectors 60 to the tape using optical fibers 70. Optical fibers 70 can be routed through holes in fiber positioning plates 71 (FIGS. 4, 5) to the precise positions required for proper detector operations.

Debris Detection

Component carrier tapes 20 are generally formed of plastic. Some tapes, however, are formed of cardboard. Cardboard tapes can abrade against guide track 32 and leave debris in the apparatus. This debris can interfere with the transmission of light through the index and sense holes and thus render system operation unreliable. In order to ensure proper operation of the apparatus, an output from phototransistor circuit 60 of FIG. 7 can be passed to a threshold detection circuit 64. Circuit 64 compares the output from phototransistor circuit 60 with a reference voltage set by a potentiometer 66. This reference voltage is generally set to be just slightly less than the corresponding output voltage from phototransistor circuit 60 when the optical path is not occluded by debris. If the optical path does become occluded, the output from circuit 60 will fall below this threshold and an indicator diode 68 will illuminate, thereby informing the operator of the occlusion detected by the photodetector.

Programmable Parts Count

In the form of the invention illustrated in FIGS. 3 and 8, means are provided for allowing the operator to inform counter 38 of the number of surface mounted components desired. In FIGS. 3 and 8, this means comprises an array of thumbwheel switches 72. The apparatus further includes a mode select switch 74 for allowing the operator to select a first or second counting mode. In the first counting mode, counter 38 counts incrementally from zero. In the second counting mode, counter 38 counts decrementally from the number entered by the operator on thumbwheel switches 72. When this count reaches zero, a stop signal can be provided by counter 38.

This embodiment can advantageously be employed in systems having means for advancing the tape from a tape reel 75, such as a toothed drive wheel 76 and an associated stepping motor 78. Toothed drive wheel 76 can cooperate with counter 38 and thumbwheel switches 72 for stopping the advancement of tape through guide track 32 after the counter indicates that the desired number of components has been provided.

Counter For Use With Clear Tape

Normally, tape 20 is formed of an optically opaque plastic. Sometimes, however, tape 20 is formed of a clear plastic. The counting scheme described earlier is not suited for operation with such clear tape because index hole photodetector 34 cannot optically distinguish between an index hole and the intervening clear tape. Consequently, counter 38 will not be caused to increment. In order to overcome this limitation, a different counting scheme must be employed.

While index hole photodetector 34 is useless with clear tape, sense hole photodetector 36 is not. Its utility, however, changes, from detecting optical continuity (indicative of an empty carrier compartment) to detecting optical discontinuity (indicative of a full carrier compartment). The number of optical interruptions detected by sense hole photodetector 36 as the tape is advanced through the apparatus thus corresponds to the number of components carried by the tape. Accordingly, to count components in an optically transmissive tape, the counter of the above described embodiment is arranged so that it simply counts optical discontinuity signals from sense hole photodetector 36.

In the preferred embodiment of the invention counter apparatus 30 detects automatically whether tape 20 is optically opaque or transmissive. It does this by monitoring the output from index hole photodetector 34. If the output from this photodetector continuously indicates optical continuity, an optically transmissive tape is being used. If, however, the output signal from the index hole photodetector occasionally indicates optical discontinuity, an opaque tape is being used.

Logic Circuit

Figure 9:
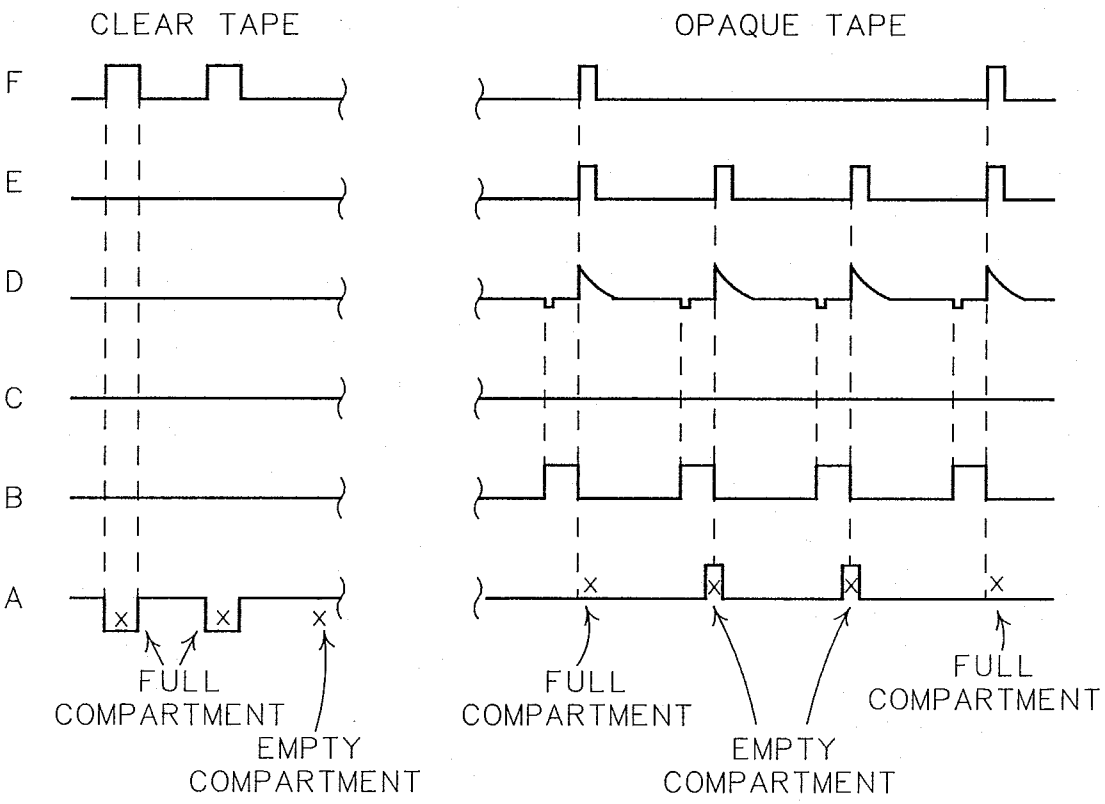
FIG. 9 is a timing diagram illustrating various signals in the logic circuit of FIG. 8.

A simple logic circuit 40 suitable for detecting the optical characteristic of tape 20 and for adapting the counting scheme accordingly is shown in FIG. 8. A timing diagram illustrating the voltages at various points in the circuit of FIG. 8 is provided in FIG. 9.

In circuit 40, the output from index hole photodetector 34 is fed to a first circuit input 80. This signal is at a logic low state when optical discontinuity is detected and is at a logic high state when optical continuity is detected. Similarly, the output from sense hole photodetector 36 is coupled to a second circuit input 82. This signal, too, is at a logic low state when optical discontinuity is detected and is at a logic high state when optical continuity is detected.

If the tape is optically transmissive, the signal from index hole photodetector 34 applied to first circuit input 80 is always at a logic high state. This signal drives the output of a first inverter stage 84 to a logic low state. This signal in turn drives the output of a second inverter stage 86 back to a logic high state. This logic high signal from the output of second inverter 86 is applied to a clock input 88 of a type 74LS74 D flip flop circuit 90. Flip flop 90 and counter 38 are reset at the beginning of operation by a pulse applied to a system reset line 92. When flip flop 90 is so reset, the signal at the not-Q output 94 is logic high. This signal remains logic high until a logic high signal tied to D input 96 is clocked through the flip flop by a clock pulse applied to clock input 88.

As long as the tape is optically transmissive and the output from index hole photodetector 34 remains high, the signal applied to clock input 88 of flip flop 90 remains high. Consequently, the signal at not-Q output 94 remains high. This signal is applied to an input of OR gate 98. This high signal causes the output of OR gate 98 to stay high. This high signal is then applied to a first input 100 of an AND gate 102. All of these signals stay at a logic high state so long as the tape passed through counter apparatus 30 is optically transmissive.

If the tape passed through the counter apparatus is optically transmissive, the output from sense hole detector 36 will fall low momentarily each time a component is detected in the tape. This logic low signal is inverted by a third inverting stage 104 to a logic high pulse. This logic high pulse is applied to a second input 106 of AND gate 102 where it is ANDed with the constantly high signal from the output of OR gate 98. The output of AND gate 102 thus produces a logic high pulse each time a component in the clear carrier tape passes through sense hole photodetector 36. These logic high pulses are counted by counter circuit 38. The count from counter circuit 38 is displayed in a four digit display 108 and represents the total number of components that have passed through apparatus 30.

The circuitry comprising counter circuit 38 is conventional and is familiar to those skilled in the art. In the preferred embodiment, counter circuit 38 is built around an Intersil type ICM 7217 4-Digit CMOS Up/-Down Counter and Display Driver integrated circuit. The Intersil data sheet on this integrated circuit includes schematic diagrams for suitable counter circuits, together with data teaching the interconnection of the counter with components such as the display, the thumbwheel switches, the mode select switch and the toothed drive wheel. The Intersil counter circuit can be preloaded with an initial count so that the count number displayed corresponds to the number of components on the tape that is protruding from the apparatus.

In the event the tape passed through counter apparatus 30 is opaque, logic circuit 40 will immediately convert to a second counting scheme. If an opaque tape is passed through the apparatus, the signal applied to first circuit input 80 by index hole photodetector 34 will fall low when the opaque tape interrupts optical continuity through the tape. This low signal is inverted to a logic high signal by first inverter 84 and back again to a logic low signal by second inverter 86. These and subsequent transitions of the signal from second inverter 86 are applied to clock input 88 of flip flop 90 and cause the logic high signal tied to D input 96 to be clocked through the flip flop to the output. The not-Q output 94 is thus brought to a logic low state. The flip flop 90 remains in this state for the rest of its operation, until reset again by system reset line 92. The signal on not-Q line 94 is thus always low with optically opaque tape, so that OR gate 98 produces a logic high state only when the signal applied to its other input goes high.

Each time an index hole is detected by index hole photodetector 34, the signal applied to first circuit input 80 goes high and the resulting signal at the output of inverter 84 goes low. The falling transition of this pulse is coupled through a coupling capacitor 110 and is clamped to a logic low level by diode 112. As the index hole passes out of view of index hole photodetector 34, the signal applied to input 80 returns low, causing the output of first inverter stage 84 to go high. This rising transition is coupled through coupling capacitor 110 and is not clamped by diode 112 because the diode is reversed bias in this instance. The positive going pulse is instead applied across a pulse shaping resistor 114 and into a fourth inverter stage 116. Fourth inverter 116 squares up this pulse and produces a logic low output pulse. This logic low pulse is applied to the input of a fifth inverter stage 118 and is inverted back to a logic high pulse. This logic high pulse is applied to the input of OR gate 98 and causes its output to pulse high. Thus, a logic high pulse is applied to input 100 of AND gate 102 every time an index hole in the opaque tape passes out of view of index hole photodetector 34.

Second input 106 of AND gate 102 is driven through third inverter 104 from the output of sense hole photodetector 36. Normally, the output of sense hole photodetector 36 is at a logic low state because the opaque tape and components over the sense holes block optical continuity. This logic low signal is inverted by third inverter 104 to a logic high signal and is applied to second input 106 of AND gate 102. With the second input of AND gate 102 so biased, every logic high pulse produced by OR gate 98 is passed on to counter 38 where it is counted. Thus, in the normal course of operation with opaque tape, every index hole detected by index hole photodetector 34 is counted by the counter. This number would represent the total number of components carried by the tape if each of the carrier compartments were filled with a component. However, since not all compartments are carrying components, the logic is arranged so that an index hole will not be counted if sense hole photodetector 36 detects an empty carrier compartment.

If sense hole photodetector 36 detects an empty carrier compartment, the input to third inverter stage 104 goes high, thereby producing logic low signal at the second input 106 of AND gate 102. When AND gate 102 is biased in this manner, no logic high output pulses can be produced, regardless of the signal applied to AND gate input 100. Accordingly, if an empty compartment is detected in the opaque tape, the usual count of each index hole is inhibited. The total count gated to and accumulated by counter 38 represents the number of index holes (i.e. the number of carrier compartments) less the number of unobstructed sense holes (i.e. empty carrier compartments). The count thus represents the total number of components that have passed through the photodetectors.

The optical fibers 70 coupling the first and second photoelectric detectors 34 and 36 to the tape are spaced relative to one another so that the logic low signal at second input 106 of AND gate 102 persists during the entire logic high pulse at first input 100 of the AND gate caused by an index hole 24 passing out of view of index hole photodetector 34. The logic low signal must persist for this entire period in order to be effective in inhibiting the counting of the logic low pulse caused by the index hole. The criticality of the fiber spacing can be eliminated if the signal from sense hole photodetector 36 is used to decrement counter 38, instead of using it to inhibit an increment caused by a coincident signal from index hole photodetector 36. If such a decrementing signal were used, the relative timing of the signals from the index and sense hole photodetectors would be irrelevant. Having illustrated and described the principles of my invention with reference to a preferred embodiment, it should be apparent to those skilled in the art that the invention can be modified in arrangement and detail without departing from such principles. Accordingly, I claim as my invention all such modifications as may come within the spirit and scope of the following claims and equivalents thereof.

I claim:

1. An apparatus for supplying a selected number of electrical components on a tape carrying such components in carrier compartments, the tape having index holes along its edge spaced at regular intervals corresponding to the spacing between adjacent carrier compartments, the apparatus comprising:

guide means for positioning the tape in a desired orientation as said tape is moved through said guide means;

first detector means positioned for detecting said index holes when the tape is moved through the guide means;

counter means for counting the index holes detected by the first detector means;

second detector means positioned for detecting carrier compartments that are not carrying components when the tape is moved through the guide means; and inhibit means for preventing the counter means from counting any index hole detected immediately following the detection by the second detector means of an empty carrier compartment, whereby tape can be moved through the guide means until the selected number of index holes has been counted by the counter means indicating that the selected number of components has been supplied.

2. The apparatus of claim 1 in which the guide means comprises means defining a slot through which the tape can be routed to position the tape in a desired orientation with said index holes aligned with said first detector means.

3. The apparatus of claim 2 in which the guide means includes means for receiving adapters which define slots of various widths so that the apparatus can be adapted for use with tapes of various widths.

4. The apparatus of claim 1 in which the guide means comprises:

a first registration member against which a first edge of the tape can abut when it is pulled off a reel; and a second registration member against which an opposite, second edge of the tape can abut when it is pulled off the reel, the second registration member being movable so as to permit operation of the apparatus with tapes of differing widths.

5. The apparatus of claim 4 in which the second registration member is spring biased towards the first registration member, whereby the movable registration member is urged against the tape regardless of its width, thereby enabling the apparatus automatically to adapt to tapes of differing widths.

6. The apparatus of claim 1 for use with light opaque tapes that have sense holes in the component carrier compartments for determining whether said compartments are carrying components, in which:

the first and second detector means both comprise photoelectric source and detector pairs positioned for detecting optical continuity through the index holes and the sense holes, respectively.

7. The apparatus of claim 6 which further comprises means for adjusting the sensitivity of the first and second detector means, whereby the sensitivity of said means can be varied to optimize performance of the apparatus with tapes of differing optical qualities.

8. The apparatus of claim 6 which further comprises optical fiber means for coupling the first and second photoelectric sources to the detector pairs.

9. The apparatus of claim 1 which further comprises:

programmable means for allowing a user to enter the number of surface mount components desired;

mode select means for allowing the user to select a first or second counting mode; and means included in the counter means for counting incrementally from zero when the user has selected the first counting mode and for counting decrementally from the number entered by the user when the user selects the second counting mode.

10. The apparatus of claim 9 in which the programmable means comprises thumb wheel switches.

11. The apparatus of claim 1 which further comprises:

programmable means for allowing a user to enter the number of surface mount components desired; and tape drive means for advancing the tape through the guide means by engagement with the index holes, the tape drive means cooperating with the counter means and the programmable means for stopping the advancement of tape through the guide means when the desired number of components has been provided.

12. An apparatus for providing a selected number of electrical components on a tape carrying such components in carrier compartments, the tape having index holes along an edge portion spaced at regular intervals corresponding to the spacing between adjacent carrier compartments and further having carrier compartment sense holes in each of said compartments, the apparatus comprising:

guide means for positioning the tape in a desired orientation as the tape is moved through the guide means;

tape detector means for detecting whether the tape is optically transmissive or opaque; and detector means includes means for detecting said opaque tape signal.

13. The apparatus of claim 12 in which the first optical detector means generates an opaque tape signal when optical continuity is not detected through the edge portion of the tape and in whch the tape if the tape is optically transmissive, the method further comprising the steps:

detecting the interruption of a light beam directed through the tape in the region containing the component carrier compartments; and counting the number of such interruptions; if the tape is optically opaque, the method further comprising the steps:

counting the number of index holes as the tape is advanced;

detecting whether any of the component carrier compartments are empty as the tape is advanced; and inhibiting the counting of an index hole each time an empty carrier compartment is detected;

whereby the number of components carried by the tape advanced off the reel are counted regardless of whether the tape is optically transmissive or opaque.

14. A method for supplying a selected number of electrical components on a tape carrying such components in carrier compartments, the tape having index holes along its edge spaced at regular intervals corresponding to the spacing between adjacent carrier compartments and further having carrier compartment sense holes for determining whether a compartment is carrying a component, the method comprising the steps:

advancing the tape;

detecting index holes as the tape is advanced;

counting the number of index holes detected;

detecting whether any of the component carrier compartments are empty as the tape is advanced; and inhibiting the counting of an index hole each time an empty carrier compartment is detected.

15. The method of claim 14 which further comprises detecting optical continuity through the index holes and detecting optical continuity through the sense holes in order to detect index holes and to detect whether any of the component carrier compartments are empty, respectively.

16. A method for supplying a selected number of electrical components on a tape carrying such components in carrier compartments, the tape having index holes along its edge spaced at regular intervals corresponding to the spacing between adjacent carrier compartments and further having carrier compartment sense holes for determining whether a compartment is carrying a component, the method comprising the steps:

advancing the tape;

detecting whether the tape is optically opaque or transmissive; and counting means for counting the components, the counting means comprising:

first optical detector means for detecting optical continuity through the edge portion of the tape and for generating a first output signal when optical continuity is detected, said first detector means detecting optical continuity continuously when an optically transmissive tape is moved through the guide means;

second optical detector means for detecting optical continuity through the carrier compartment sense holes and for generating an inhibit signal when optical continuity is detected and for generating a second output signal when optical continuity is not detected; and logic means for counting selected ones of said first and second output signals depending on whether the tape detector means determines that the tape is optically transmissive or opaque;

said logic means counting the second output signals when the tape detector means detects that the tape is optically transmissive; and said logic means counting the first output signsls when the tape detector means detects that the tape is optically opaque, but preventing the counting of a first output signal following the generation by the second optical detector means of an inhibit signal;

whereby the number of components carried by the tape is counted regardless of whether the tape is optically transmissive or opaque.

17. The method of claim 16 which further comprises the steps:

counting the number of index holes by detecting the transmission of a light beam directed through the tape in the region containing the index holes and counting the number of such transmissions; and detecting whether any of the component carrier compartments are empty by detecting the transmission of a light beam directed through the tape in the region containing the component carrier compartments.

* * * * *